United States Patent [19]

Kobayashi

[11] 4,051,710

[45] Oct. 4, 1977

[54] PULL TAB ATTACHMENT TOOL

[75] Inventor: Yasuhiro Kobayashi, Nyuzen, Japan

[73] Assignee: Yoshida Kogyo K.K., Japan

[21] Appl. No.: 753,479

[22] Filed: Dec. 22, 1976

[30] Foreign Application Priority Data

Dec. 29, 1975 Japan ..... 50-178459

[51] Int. Cl.[2] ..... B21D 9/08

[52] U.S. Cl. ..... 72/410; 81/5.1 R; 81/311

[58] Field of Search ..... 72/409, 410; 81/303, 81/311, 312, 5.1 R

[56] References Cited

U.S. PATENT DOCUMENTS

| | | | |
|---|---|---|---|
| 876,963 | 1/1908 | Hoak | 81/311 |
| 2,063,167 | 12/1936 | Kamborian | 81/311 |
| 2,732,744 | 1/1956 | Kuchman | 72/409 |

*Primary Examiner*—C.W. Lanham

*Assistant Examiner*—Gene P. Crosby

*Attorney, Agent, or Firm*—Bucknam and Archer

[57] ABSTRACT

A pull tab attachment tool comprises a pair of first and second levers connected together for pivotal movement and having respectively first and second handle portions and opposed jaw portions extending from their one ends. The second lever has a roller. A third lever is pivotally connected to the first lever. An urging means acts between the first and third levers to normally urge them apart so that the third lever is held in rolling engagement with the roller. When the first and second handle portions are manually actuated to move toward each other, the opposed jaw portions are brought into engagement with each other to provide a first pressing structure, and one end of the third lever is brought into engagement with the one end of the first lever through the rolling action of the roller along the third lever to provide a second pressing structure.

3 Claims, 4 Drawing Figures

PULL TAB ATTACHMENT TOOL

BACKGROUND OF THE INVENTION

1. Field of the Invention

This invention relates to a manually operative tool for attaching a pull tab to a slider body to provide a slider for slide fasteners.

2. Prior Art

Generally, connection between a pull tab and a slider body is made through the agency of a coupling link, the link being coupled at one end thereof to a loop portion of the slider and at the other end to the pull tab. One conventional type of connection between a pull tab and coupling link is known in which the coupling link has a hook portion at one end thereof remote from the slider loop, which portion is adapted to be deformed under compression to hold the pull tab in place. There is known another conventional arrangement of a pull tab and coupling link in which the pull tab has a bifurcated end adapted to be deformed under compression to hold the coupling link in position. Heretofore, these two different types of pull tab-attaching operation have been carried out by the use of separate, specially-designed pull tab attachment tools. With these conventional pull tab attachment tools, however, the pull tab-attaching operation can not be carried out efficiently where it is required to perform these two different operations alternately or in a random manner, because it becomes necessary to exchange the tools to suit the particular one of the two modes of attaching operation.

SUMMARY OF THE INVENTION

It is therefore an object of the present invention to provide a pull tab attachment tool suitable for carrying out both of the above-mentioned two different types of pull tab-attaching operation.

According to the invention, there is provided a pull tab attachment tool comprising a pair of first and second levers having respectively first and second handly portions and opposed first and second jaw portions extending from their one ends in a common direction. The first and second levers are pivotably connected together adjacent to the one ends thereof. The second lever has a roller intermediate the opposite ends thereof, and the first lever has an outwardly opening pull tab-receiving slot at the one end thereof which also opens in a direction away from the first jaw portion and defines a pair of laterally spaced apart seat surfaces at its opening facing away from the first jaw portion. A third lever is pivotably connected at one end thereof to the other end of the first lever, the third lever having at one end thereof an outwardly-opening punching depression facing the pair of seat surfaces. An urging means acts between the first and third levers and normally urges the third lever away from the first handle portion whereby the third lever is held in rolling engagement with the roller to spread the first and second handle portions apart with the opposed jaw portions held away from each other. When the first and second handle portions are manually actuated to move toward each other, the opposed jaw portions are brought into engagement with each other to provide a first pressing structure, and the one end of the third lever is brought into engagement with the one end of the first lever through the rolling action of the roller along the third lever, with the punching depression in alignment with the pair of seat surfaces to provide a second pressing structure.

Many other advantages and features of the present invention will become manifest to those versed in the art upon making reference to the detailed description and the accompanying sheets of drawings in which preferred structural embodiments incorporating the principles of the present invention are shown by way of example.

DETAILED DESCRIPTION OF THE PREFERRED EMBODIMENT

Figure 1:
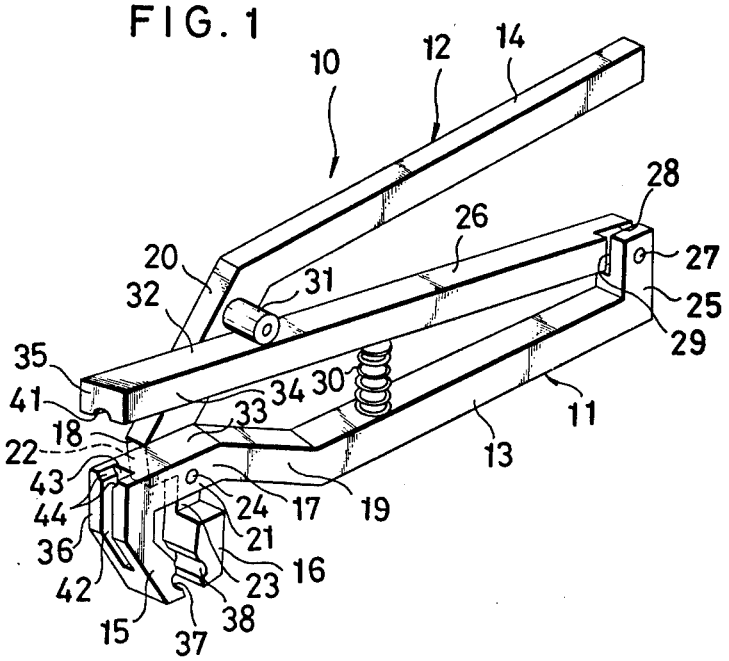
FIG. 1 is a perspective view of a pull tab attachment tool in its inoperative condition which is provided in accordance with the present invention.

FIG. 1 shows a manually operative pull tab attachment tool or device 10 which comprises first and second levers 11,12 having respectively handle portions 13,14, a cooperative pair of opposed jaw portions 15,16 at their one ends remote from the handle portions 13,14, and intermediate portions 17,18 therebetween having respectively angular sections 19,20 oriented angularly with respect to the handle portions 13,14 and directed toward each other and intersecting sections 21,22 intersecting each other in contacting relationship to each other. The first intersecting section 21 has an L-shaped configuration, and that portion 23 of the second intersecting section 22 extending beyond the first intersecting section 21 is reduced in thickness or a dimension in the longitudinal direction of the pull tab attachment tool 10, the thinned portion 23 being obtusely inclined with respect to the second handle portion 14. The first and second levers 11,12 are connected together by a pivot pin 24 passing through the intersecting sections 21,22 for pivotal movement between their respective inoperative positions in which the first and second handle portions 13,14 are spread apart with the opposed jaw portions 15,16 held away from each other (FIG. 1) and operative positions in which the handle portions 13,14 are disposed in substantially parallel relationship to each other with the jaw portions 15,16 held together or closed. The first lever 11 has at its end remote from the jaw portion 15 a lug 25 extending substantially at a right angle to the first handle portion 13. The first lever 11 has a uniform width or a dimension in the transverse direction thereof throughout the entire length thereof, and the second lever 12 is smaller in width than the first lever 11 except for the jaw portion 16 which has the same width as the opposed companion jaw portion 15 and is disposed in alignment therewith in the longitudinal direction of the pull tab attachment tool 10. The first jaw portion 15 is directed toward the opposed jaw portion 16 so that the jaw portion 15 and the intermediate portion 17 jointly provide a hook-like configuration when viewed in the transverse direction of the pull tab attachment tool 10.

Figure 2:
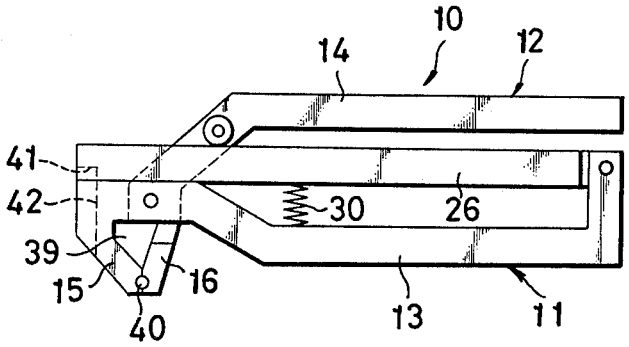
FIG. 2 is a side elevational view of the pull tab attachment tool in its operative condition.

The pull tab attachment tool 10 also includes a third lever 26 in the form of a straight bar, the third lever 26 being pivotably connected at one end thereof to the lug 25 of the first lever 11 by a pin 27 passing therethrough. The third lever 26 is of the same width as the first lever 11, and the pivoted ends of the third lever 26 and the lug 25 are recessed or cut away as at 28 and 29, respectively, the recesses 28,29 facing and being mated with each other such that the third lever 26 is disposed in alignment with the first lever 11 when viewed in a direction of the height of the pull tab attachment tool 10. An urging means 30 is provided to normally urge the first and third levers 11,26 apart, the urging means 30 here comprising at least one compression spring acting between the first handle portion 13 and third lever 26. The third lever 26 is urged by the compression spring 30 to normally rotate or angularly move about the pivot pin 27 away from the first lever 11. The second lever 12 has a roller 31 rotatably secured to the intermediate portion 18 adjacent to the handle portion 14, the roller 31 being attached to the side of the angular section 20 facing the first lever 11. As shown in FIG. 1, the roller 31 serves as a stop means for limiting the pivotal angular movement of the third lever 26 away from the first lever 11. The compression spring 30 urges the third lever 26 into rolling engagement with the roller 31. As the first and second handle portions 13,14 are manually actuated to move from their respective inoperative positions (FIG. 1) to operative positions (FIG. 2), the roller 31 rolls along the upper surface 32 of the third lever 26 to urge the same to move against the bias of the compression spring 30 from an inoperative position in which the third lever 26 is spread outwardly apart from the handle portion 13 to an operative position in which the third lever 26 is held substantially in parallel relationship to the first and second handle portions 13,14. The upper surface 33 of the L-shaped intersecting section 21 is capable of serving as an abutment surface against which the distal or free end portion 34 of the third lever 26 abuts, with its end face 35 lying flush with the outer surface 36 of the L-shaped section 21, when the third lever 26 is in its operative position. The opposed jaw portions 15,16 have a cooperative pair of semi-circular or arcuate recesses 37,38 formed in their confronting surfaces adjacent to their distal ends and extending the entire width thereof, the semi-circular recesses 37,38 serving as active pressing surfaces as explained later. When the first and second handle portions 13,14 are manually actuated to their respective operative positions (FIG. 2) with the jaw portions 15,16 closed to define together with the L-shaped section 21 an irregular tetragon-shaped space 39, the semi-circular recesses 37,38 are brought into alignment with each other to define an opening 40 of substantially circular cross section through the abutted jaw ends. The semi-circular recesses 37,38 serve as a first pressing structure as will hereinafter more fully be described.

The third lever 26 has an outwardly opening semi-circular depression 41 formed in its distal end 34 and facing the abutment surface 33 of the L-shaped section 21. The first lever 11 has a pull tab-receiving slot 42 formed in the L-shaped section 21 and extending into the jaw portion 15, the slot 42 opening to the abutment surface 33 and having a flat bottom surface 43. The semi-circular depression 41 is substantially equal in depth or a dimension in the longitudinal direction of the pull tab attachment tool 10 to the pull tab-receiving slot 42. The slot 42 is tapered at its end opening to the abutment surface 33 to provide a pair of concave arcuate seat surfaces 44,44. The semi-circular depression 41 is brought into alignment with the pull tab-receiving slot 42 as shown in phantom in FIG. 2 when the third lever 26 is moved to its operative position with its distal end portion 34 held against the abutment surface 33 of the L-shaped section 21, by manually operating the first and second handle portions 13,14. The semi-circular depression 41 cooperates with the pull tab-receiving slot 42 to form a second press structure, and the arcuate surface of the depression 41 serves as a punch and the pair of arcuate seat surfaces 44,44 as a die as will hereinafter more fully be described.

Figure 3:
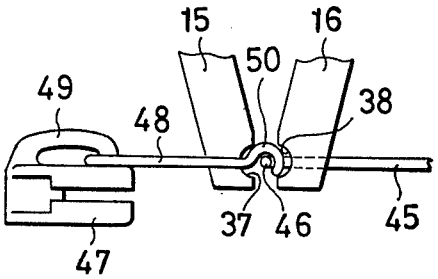
FIG. 3 is an enlarged front elevational view of a portion of the pull tab attachment tool representing its first pressing structure, illustrating a pull tab being attached to a slider link.

It will be seen from FIG. 3 that the first press structure is utilized when a pull tab 45 having a transverse pintle 46 at one end thereof, such those of a link-like configuration, is to be attached to a slider 47 via a coupling link 48 pivotably coupled at one end thereof to a loop 49 of the slider 47 and having a hook portion 50 at the other end for supporting the pull tab 45. The pull tab pintle 45 is first hooked by the hook portion 50 of the coupling link 48, and the pair of jaw portions 15,16 are inserted through the coupling link 48 and the pull tab 45, respectively, with the hook portion 50 interposed between the opposed semi-circular recesses 37,38.

The curvature of the outer periphery of the hook portion 50 is slightly greater than those of the semi-circular recesses 37,38. Then, the first and second handles 13,14 are manually actuated to move toward each other against the bias of the compression spring 30 to close the opposed jaw portions 15,16 so that the hook portion 50 is compressed or deformed by the coacting semi-circular recesses 37,38 into a substantially circular configuration to completely surround the pull tab pintle 46, thereby holding the pull tab 45 in place.

Figure 4:
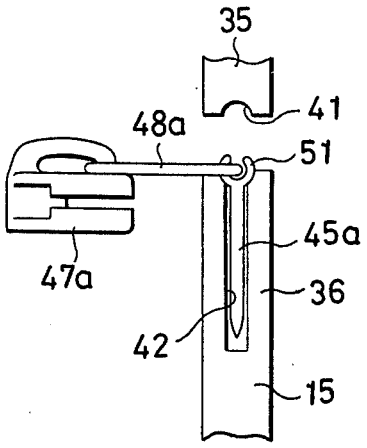
FIG. 4 is an enlarged side elevational view of a portion of the pull tab attachment tool representing its second pressing structure, illustrating a pull tab being attached to a slider link.

When a pull tab **45*a* having a bifurcated end 51 is to be attached to a slider 47*a* via a coupling link 48*a* of the standard type, the second press structure is utilized as seen in FIG. 4. The pull tab 45*a* is first inserted in the pull tab-receiving slot 42 with the bifurcated end 51 of substantially C-shaped cross section rested on the arcuate concave seat surfaces 44,44. Then, the first and second handles 13,14 are manually operated to move the third lever 26 toward the first lever 11 against the bias of the compression spring 30 through the rolling action of the roller 31 along the upper surface 32 of the third lever 26 to bring its distal end 34 into abutting engagement with the abutment surface 33 of the L-shaped section 21, so that the bifurcated end 51 of the pull tab 45*a* is compressed or deformed into a substantially circular configuration by a punching action of the semi-circular depression 41 to hold the coupling link 48*a*** in place.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A pull tab attachment tool comprising:

a. a pair of first and second levers having respectively first and second handle portions and opposed first and second jaw portions extending from their one ends in a common direction, said first and second levers being pivotably connected together adjacent to said one ends thereof, said second lever having a roller intermediate the opposite ends thereof, and said first lever having an outwardly opening pull tab-receiving slot at said one end thereof which also opens in a direction away from said first jaw portion and defines a pair of laterally spaced apart seat surfaces at its opening facing away from said first jaw portion;

a third lever pivotably connected to the other end of said first lever, said third lever having an outwardly-opening punching depression at one end thereof, and said depression facing said pair of seat surfaces;

an urging means acting between said first and third levers and normally urging said third lever away from said first handle portion whereby said third lever is held in rolling engagement with said roller to spread said first and second handle portions apart with said opposed jaw portions held away from each other; and d. whereby when said first and second handle portions are manually actuated to move toward each other, said opposed jaw portions are brought into engagement with each other to provide a first pressing structure, and said one end of said third lever is brought into engagement with said one end of said first lever through the rolling action of said roller along said third lever, with said punching depression in alignment with said pair of seat surfaces to provide a second pressing structure.

2. A pull tab attachment tool according to claim 1, in which said opposed jaw portions have confronting recesses of substantially semi-circular cross section which extend across the entire widths thereof and serve as co-acting active pressing surfaces.

3. A pull tab attachment tool according to claim 1, in which said punching depression is of substantially semi-circular cross section, and said pair of seat surfaces are concave and arcuate.

* * * * *